US008459369B2

(12) United States Patent
Eckholm et al.

(10) Patent No.: US 8,459,369 B2
(45) Date of Patent: Jun. 11, 2013

(54) METHODS AND APPARATUS FOR HAZARD CONTROL AND SIGNALING

(75) Inventors: William A. Eckholm, Scottsdale, AZ (US); Matthew Sampson, Phoenix, AZ (US)

(73) Assignee: Firetrace USA, LLC, Scottsdale, AZ (US)

( * ) Notice: Subject to any disclaimer, the term of this patent is extended or adjusted under 35 U.S.C. 154(b) by 276 days.

(21) Appl. No.: 12/907,872

(22) Filed: Oct. 19, 2010

(65) Prior Publication Data

US 2011/0061878 A1 Mar. 17, 2011

Related U.S. Application Data

(63) Continuation-in-part of application No. 12/172,148, filed on Jul. 11, 2008, now Pat. No. 7,823,650.

(60) Provisional application No. 60/949,586, filed on Jul. 13, 2007.

(51) Int. Cl.

| | |
|---|---|
| ***A62C 37/36*** | (2006.01) |
| ***A62C 37/38*** | (2006.01) |
| ***A62C 37/00*** | (2006.01) |

(52) U.S. Cl.

USPC ..... 169/20; 169/23; 169/56; 169/60

(58) Field of Classification Search

USPC ..... 169/16, 17, 19, 20, 23, 43, 46, 56, 169/60, 61

See application file for complete search history.

(56) References Cited

U.S. PATENT DOCUMENTS

| | | | |
|---|---|---|---|
| 3,602,313 | A | 8/1971 | Achs |
| 3,738,428 | A | 6/1973 | Ingro |
| 4,356,868 | A | 11/1982 | Bentley et al. |
| 4,650,003 | A | 3/1987 | Euson |
| 5,954,138 | A | 9/1999 | Gabriel |
| 6,029,751 | A | 2/2000 | Ford et al. |
| 7,456,750 | B2 | 11/2008 | Popp et al. |
| 7,712,542 | B2 | 5/2010 | Munroe |
| 7,810,577 | B2 | 10/2010 | Popp et al. |

(Continued)

FOREIGN PATENT DOCUMENTS

WO 2007111897 A1 10/2007

OTHER PUBLICATIONS

David M. Gray, Fire Protection Moves "Inside the Box," Firewatch! Mar. 2003, pp. 24-25.t.

(Continued)

*Primary Examiner* — Darren W Gorman
(74) *Attorney, Agent, or Firm* — The Noblitt Group, PLLC

(57) ABSTRACT

A hazard control system according to various aspects of the present invention is configured to deliver a control material in response to detection of a hazard and signal a secondary hazard detection system that an event has occurred. In one embodiment, the hazard control system comprises a pressure tube having an internal pressure that is configured to leak in response to exposure to heat. The leak changes the internal pressure and generates a pneumatic signal. A valve may be coupled to the pressure tube and be configured to release the control material from a container is response to the pneumatic signal. A second valve may also be coupled to the pressure tube and be configured to provide a signal to the secondary hazard detection system in response to the pneumatic signal.

19 Claims, 5 Drawing Sheets

U.S. PATENT DOCUMENTS

| | | | | |
|---|---|---|---|---|
| 2002/0121381 | A1 | 9/2002 | Reilly | |
| 2002/0125372 | A1 | 9/2002 | Shooflar | |
| 2007/0008157 | A1 | 1/2007 | Siemens et al. | |
| 2008/0017393 | A1 * | 1/2008 | Whitney | 169/60 |
| 2008/0224877 | A1 | 9/2008 | Young | |
| 2009/0084561 | A1 | 4/2009 | Popp et al. | |
| 2009/0178813 | A1 | 7/2009 | Eckholm | |
| 2010/0258324 | A1 | 10/2010 | Bryson et al. | |

OTHER PUBLICATIONS

William A. Eckholm, Fire Protection for Cabinets and Enclosures, Fire-Suppression & Protection, Airport Technology International.

David Gray, An Automatic Fire-Suppression System for the Laboratory, reprinted from American Laboratory News, Jan. 2002.

It's Time to Start Thinking "Inside" the Box!, Firetrace Automatic Fire Suppression Systems Brochure, NFPA World Safety Conference and Exposition, May 2004, Salt Lake City, Utah.

Fire Protection: The Impossible is Now Possible!, North American Windpower, May 2005.

Technical Member Profile: Firetrace International, Production Machining, Aug. 2005, p. 18.

Fire Protection: The Impossible is Now Possible!, advertisement in Renewable Energy World, Jul.-Aug. 2004, p. 14.

Protecting Your Micro-Environment, Firetrace Automatic Fire Suppression Systems Brochure.

* cited by examiner

METHODS AND APPARATUS FOR HAZARD CONTROL AND SIGNALING

CROSS-REFERENCES TO RELATED APPLICATIONS

This application is a continuation-in-part of U.S. patent application Ser. No. 12/172,148, filed on Jul. 11, 2008 now U.S. Pat. No. 7,823,650, which claims the benefit of U.S. Provisional Patent Application No. 60/949,586, filed on Jul. 13, 2007, and incorporates the disclosure of each application in its entirety by reference. To the extent that the present disclosure conflicts with any referenced application, however, the present disclosure is to be given priority.

BACKGROUND OF THE INVENTION

Hazard control systems often comprise a smoke detector, a control board, and an extinguishing system. When the smoke detector detects smoke, it sends a signal to the control board. The control board then typically sounds an alarm and triggers the extinguishing system in the area monitored by the smoke detector. Such systems, however, are complex and require significant installation time and cost. In addition, such systems may be susceptible to failure in the event of malfunction or loss of power.

SUMMARY OF THE INVENTION

A hazard control system according to various aspects of the present invention is configured to deliver a control material in response to detection of a hazard and signal a secondary hazard detection system that an event has occurred. In one embodiment, the hazard control system comprises a pressure tube having an internal pressure that is configured to leak in response to exposure to heat. The leak changes the internal pressure and generates a pneumatic signal. A valve may be coupled to the pressure tube and be configured to release the control material from a container is response to the pneumatic signal. A second valve may also be coupled to the pressure tube and be configured to provide a signal to the secondary hazard detection system in response to the pneumatic signal.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in a different order are illustrated in the figures to help to improve understanding of embodiments of the present invention.

DETAILED DESCRIPTION OF EXEMPLARY EMBODIMENTS

The present invention may be described in terms of functional block components and various processing steps. Such functional blocks may be realized by any number of hardware or software components configured to perform the specified functions and achieve the various results. For example, the present invention may employ various vessels, sensors, detectors, control materials, valves, and the like, which may carry out a variety of functions. In addition, the present invention may be practiced in conjunction with any number of hazards, and the system described is merely one exemplary application for the invention. Further, the present invention may employ any number of conventional techniques for delivering control materials, sensing hazard conditions, controlling valves, and the like.

Figure 1:
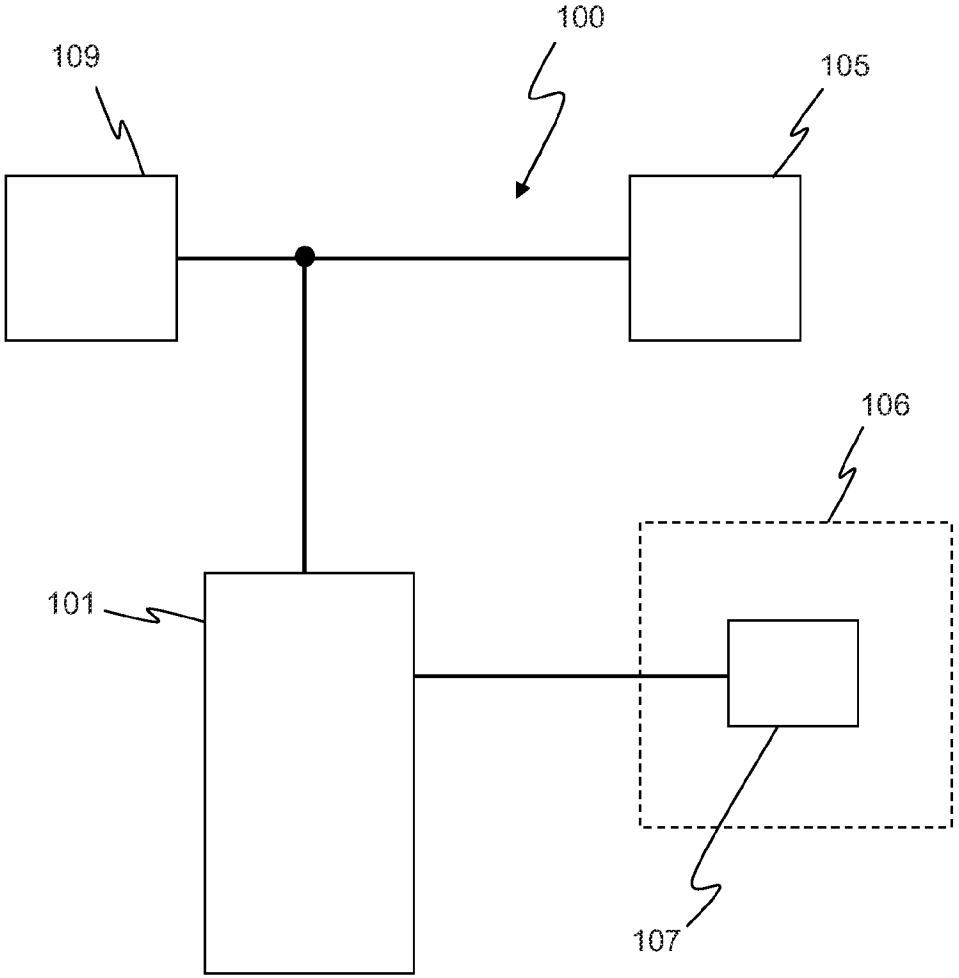
FIG. 1 is a block diagram of a hazard control system according to various aspects of the present invention.
Figure 2:
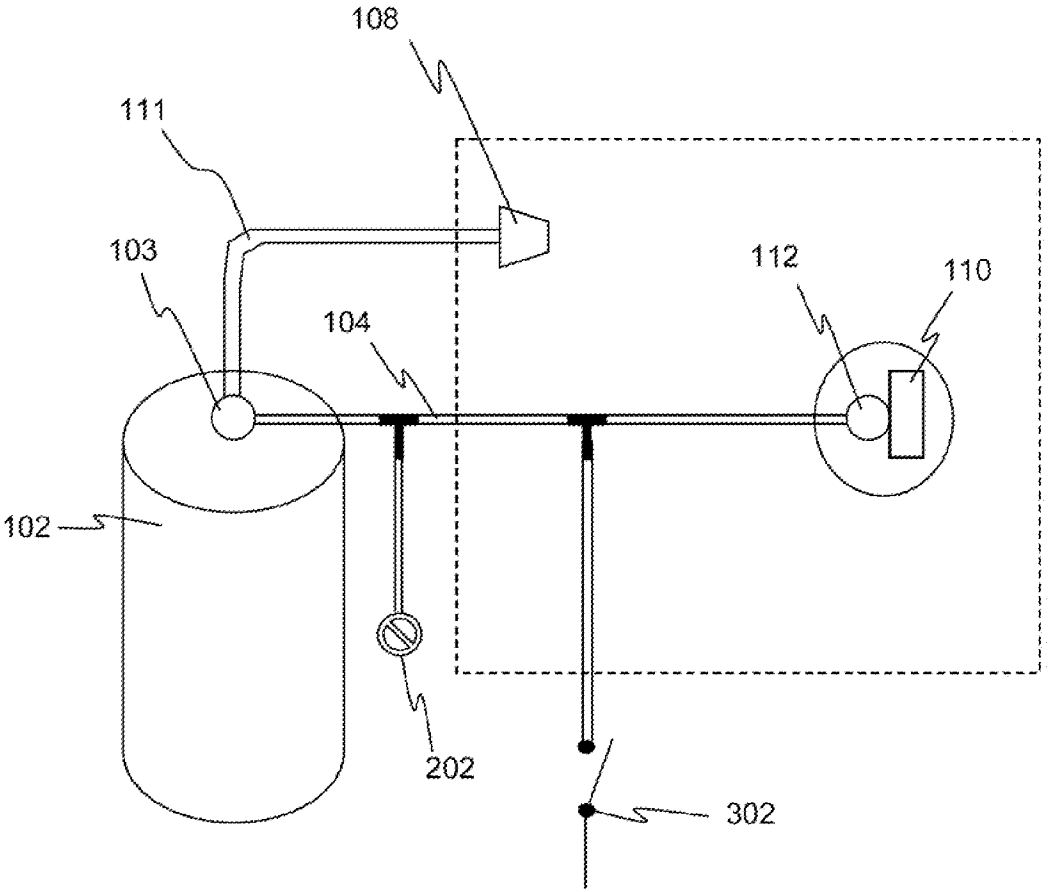
FIG. 2 representatively illustrates an embodiment of the hazard control system.

Referring now to FIGS. 1 and 2, a hazard control system 100 for controlling a hazard according to various aspects of the present invention may comprise a control material source 101 for providing a control material, for example an extinguishant for extinguishing a fire. The hazard control system 100 may further comprise a hazard detection system 105 for detecting one or more hazards, such a smoke detector, radiation detector, thermal sensor, or gas sensor. The hazard control system 100 further comprises a delivery system 107 to deliver the control material to a hazard area 106 in response to the hazard detection system 105.

The hazard area 106 is an area that may experience a hazard to be controlled by the hazard control system 100. For example, the hazard area 106 may comprise the interior of a cabinet, container, unit load device, vehicle, enclosure, and/or other area. Alternatively, the hazard area may comprise an open area that may be affected by the hazard control system 100.

A control material source 101 may comprise any appropriate source of control material, such as a storage container for containing a control material. Referring to FIG. 2, the source of control material may comprise a vessel 102 configured to store a control material for controlling a hazard. The control material may be configured to neutralize or combat one or more hazards, such as a fire extinguishant or acid neutralizer. The vessel 102 may comprise any suitable system for storing and/or providing the control material, such as a tank, pressurized bottle, reservoir, or other container. The vessel 102 may be configured to withstand various operating conditions including temperature variations of up to 300 degrees Fahrenheit, vibration, and environmental pressure changes. The vessel 102 may comprise various materials, shapes, dimensions, and coatings according to any appropriate criteria, such as corrosion, cost, deformation, fracture, and/or the like.

The vessel 102 and the control material may be adapted according the particular hazard and/or environment. For example, if the hazard control system 100 is configured to control a hazard area 106 such that the hazard area 106 maintains a low oxygen level, the vessel 102 may be configured to provide a control material which absorbs or dilutes oxygen levels when transmitted into the hazard area 106. As another example, if the hazard control system 100 is configured to control a hazard area 106 such that equipment within hazard area 106 is substantially protected from thermal radiation, the vessel 102 may be configured to provide an extinguishant which absorbs thermal radiation when transmitted into the hazard area 106.

The delivery system 107 is configured to deliver the control material to the hazard area 106. The delivery system 107 may comprise any appropriate system for delivering the control material. In the present embodiment, the delivery system 107 may include a nozzle 108 connected to the vessel 102 and disposed in or adjacent to the hazard area 106 such that control material exiting the nozzle 108 is deposited in the hazard area 106. For example, if a fire is detected in the hazard area 106, a fire extinguishing agent may be transmitted from the vessel 102 through the nozzle 108 to the hazard area 106 to extinguish the fire.

The nozzle 108 may be connected directly or indirectly to the vessel 102 to deliver the control material. For example, the nozzle 108 may be indirectly connected to the vessel 102 via a hose 111 coupled to a deployment valve 103, which controls a deployment and/or flow rate of the control material through the nozzle 108. The deployment valve 103 controls whether and, if desired, the amount or type of control material delivered through the nozzle 108. The deployment valve 103 may comprise any appropriate mechanism for selectively providing the control material for deployment via the nozzle 108, such as a ball cock, a ball valve, a butterfly valve, a check valve, a double check valve, a gate valve, a globe valve, a hydraulic valve, a leaf valve, a non-return valve, a pilot valve, a piston valve, a plug valve, a pneumatic valve, a rotary valve, and/or the like. In the present embodiment, the deployment valve 103 responds to a signal, for example a pneumatic signal from the hazard detection system 105, and controls delivery of the extinguishant via the hose 111 and nozzle 108 accordingly.

The hazard detection system 105 generates a hazard signal in response to a detected hazard. The hazard detection system 105 may comprise any appropriate system for detecting one or more specific hazards and generating a corresponding signal, such as system for detecting smoke, heat, poison, radiation, and the like. In the present embodiment, the hazard detection system 105 is configured to detect a fire and provide a corresponding signal to the deployment valve 103. The hazard signal may comprise any appropriate signal for transmitting relevant information, such as an electrical pulse or signal, acoustic signal, mechanical signal, wireless signal, pneumatic signal, and the like. In the present embodiment, the hazard signal comprises a pneumatic signal generated in response to detection of the hazard condition and provided to the deployment valve 103, which delivers the extinguishant in response to the signal. The hazard detection system 105 may generate the hazard signal in any suitable manner, for example in conjunction with conventional hazard detectors, such as a smoke detector, fusible link, infrared detector, radiation detector, or other suitable sensor. The hazard detection system 105 detects one or more hazards and generates (or terminates) a corresponding signal.

In the present embodiment, the hazard detection system 105 includes a pressure tube 104 configured to generate a signal in response to a change of internal pressure in the pressure tube 104. Referring again to FIG. 2, the hazard detection system may further comprise a smoke detector 110 configured to release the pressure in the pressure tube 104 upon detecting smoke within the hazard area 106. For example, the smoke detector 110 may be suitably adapted to activate a valve 112 connected to the pressure tube 104 to cause the internal pressure of the pressure tube 104 to change.

In the present embodiment, the hazard detection system 105 generates the pneumatic signal by changing pressure in the pressure tube 104, such as by releasing the pressure in the pressure tube 104. The pressure tube 104 may be pressurized with a higher or lower internal pressure than an ambient pressure in the hazard area 106. Equalizing the internal pressure with the ambient pressure generates the pneumatic hazard signal. The internal pressure may be achieved and sustained in any suitable manner, for example by pressurizing and sealing the pressure tube, connecting the tube to an independent pressure source such as a compressor or pressure bottle, or connecting the pressure tube 104 to the vessel 102 having a pressurized fluid and/or gas. Any fluid that may be configured to transmit a change in pressure within the pressure tube 104 may be used. For example, a substantially incompressible fluid such as a water-based fluid may be sensitive to changes in temperature and/or changes in the internal volume of the pressure tube 104 sufficient to signal coupled devices in response to a change in pressure. As another example, a substantially inert fluid such as air, nitrogen, or argon may be sensitive to changes in temperature and/or changes in the internal volume of the pressure tube 104 sufficient to signal coupled devices in response to a change in pressure. The pressure tube 104 may comprise appropriate materials, including Firetrace™ detection tubing, aluminum, aluminum alloy, cement, ceramic, copper, copper alloy, composites, iron, iron alloy, nickel, nickel alloy, organic materials, polymer, titanium, titanium alloy, rubber, and/or the like. The pressure tube 104 may be configured according to any appropriate shapes, dimensions, materials, and coatings according to desired design considerations such as corrosion, cost, deformation, fracture, combinations, and/or the like.

The pressure changes within the pressure tube 104 may occur based on any cause or condition. For example, the pressure in the tube may change in response to a release of pressure in the pressure tube 104, for example due to actuation of the pressure control valve 112. Alternatively, pressure changes may be caused by changes in the temperature or volume of the fluid in the pressure tube 104, for example in response to actuation of the pressure control valve 112 or a heat transfer system. In the present embodiment, the pressure tube 104 may be configured to degrade and leak in response to a hazard condition, such as puncture, rupture, and/or deformation which may result in altering the internal pressure of the pressure tube 104 resulting from exposure to fire-induced heat. Upon degradation, the pressure tube 104 loses pressure, thus generating the pneumatic signal.

In addition, the hazard detection system 105 may include external systems configured to activate the hazard control system 100. Various hazards produce various hazard conditions, which may be detected by the hazard detection system 105. For example, fires produce heat and smoke, which may be detected by the smoke detector 110, causing the smoke detector 110 to activate delivery of the control material.

In one embodiment, other systems may control the pressure in the pressure tube 104, such as via the pressure control valve 112. For example, the pressure control valve 112 may be configured to affect pressure within the pressure tube 104 in response to signals from another element, such as the smoke detector 110. The affected pressure may be achieved by configuring the valve 112 to selectively change the pressure within the pressure tube 104, substantially equalize the pressure within the pressure tube 104 to outside the pressure tube 104, change the temperature of the fluid within the pressure tube 104, and/or the like. For example, the smoke detector 110 may cause the pressure control valve 112 to open upon detecting smoke, thus allowing the pressure in the pressure tube 104 to escape and generate the pneumatic signal.

The pressure control valve 112 may comprise any suitable mechanism for controlling the pressure in the pressure tube 104, such as a ball cock, a ball valve, a butterfly valve, a check valve, a double check valve, a gate valve, a globe valve, a hydraulic valve, a leaf valve, a non-return valve, a pilot valve, a piston valve, a plug valve, a pneumatic valve, a rotary valve, and/or the like. In one embodiment, the pressure control valve 112 may comprise an electromechanical system coupled to an independent power source, such as a battery. For example, the pressure control valve 112 may comprise a solenoid configured to operate at between about 12 and 24 volts. The pressure control valve 112 may be configured to achieve various changes in pressure within the pressure tube 104 by varying the choice of materials, dimensions, power consumption, and/or the like.

The pressure control valve 112 may be controlled by any suitable systems to change the pressure in the pressure tube 104 in response to a trigger event. For example, the hazard detection system 105 may be configured to detect various hazardous conditions that may constitute trigger events. In the present embodiment, the smoke detector 110 may detect conditions associated with fires. The smoke detector 110 may be replaced or supplemented with detectors of other hazards, such as sensors sensitive to incidence with selected substances, radiation levels and/or frequencies, pressures, acoustic pressures, temperatures, tensile properties of a coupled sacrificial element, and/or the like. The smoke detector 110 may comprise a conventional system for fire detection, such as an ionization detector, a mass spectrometer, an optical detector, and/or the like. The smoke detector 110 may also be suitably adapted to operate solely from battery power. In an alternative embodiment, the smoke detector 110 may be adapted to operate without electrical power.

The smoke detector 110, pressure tube 104, and/or other elements of the hazard detection system 105 may be configured for any variety of fire or other hazard conditions. For example, the hazard detection system 105 may monitor for a single hazard condition, such as heat. In this representative configuration, the pressure tube 104 functions as the only detection systems for the hazard condition. Alternatively, the hazard may be associated with multiple hazard conditions, such as heat and smoke, in which case different detectors may monitor different conditions. In this configuration, the pressure tube 104 and smoke detector 110 provide hazard control based on a multiple possible hazard conditions. In addition, the pressure tube 104 and smoke detector 110 may be configured to provide hazard detection in response to partially coextensive hazard conditions. In this configuration, the pressure tube 104 and smoke detector 110 would provide substantially independent detection systems for some hazard conditions and hazard control based on a Variety of input hazard conditions for other hazard conditions. Given the multiplicity of combinations of fire conditions, these examples are illustrative rather than exhaustive.

The smoke detector 110 and the pressure control valve 112 may be configured in any suitable manner to facilitate communication and/or deployment. For example, in one embodiment, the smoke detector 110 may include a wireless transmitter and the pressure control valve 112 may include a wireless receiver to receive wireless control signals from the smoke detector 110, which facilitates remote placement of the smoke detector 110 relative to the pressure control valve 112. Alternatively, the smoke detector 110, pressure control valve 112, and/or other elements of the hazard detection system may be connected by hardwire connections, infrared signals, acoustic signals, and the like.

Figure 3:
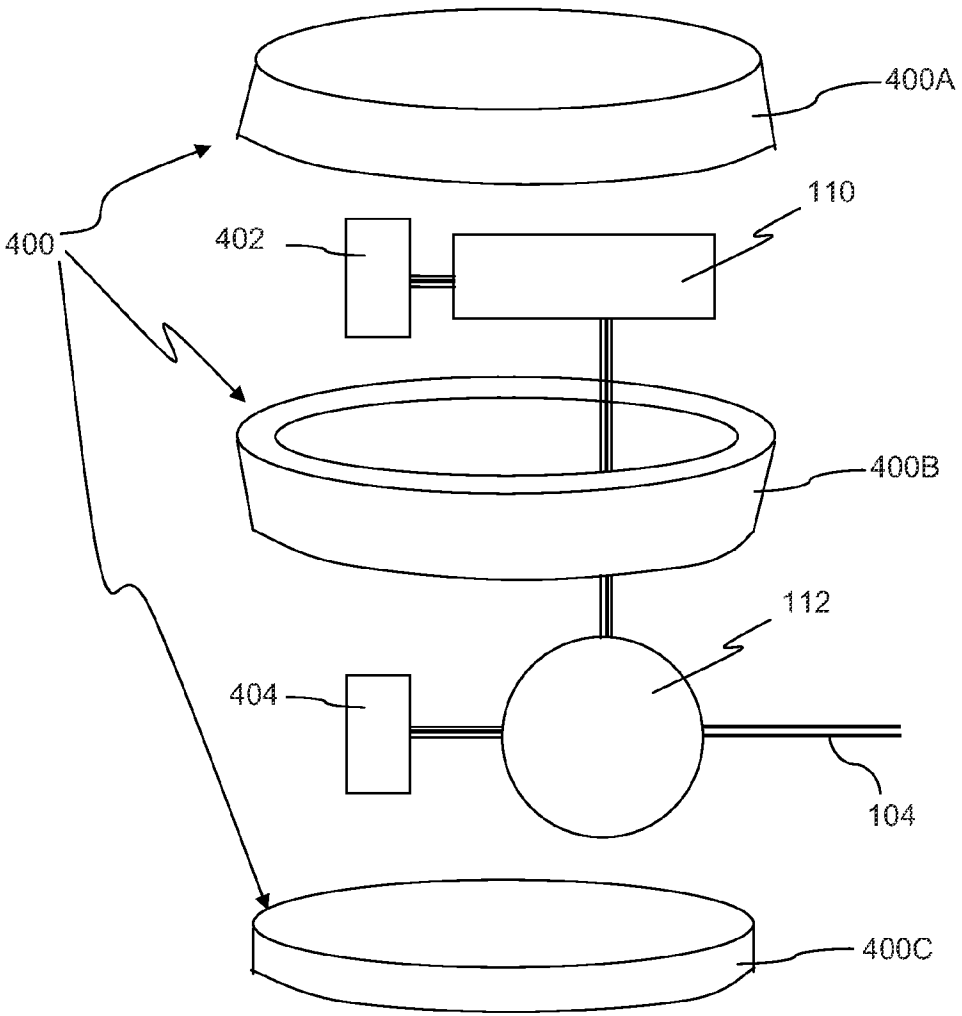
FIG. 3 is an exploded view of a hazard detection system including a housing.

Referring to FIG. 3, the smoke detector 110 and pressure control valve 112 may be at least partially disposed within a housing 400 to form a single unit. The housing 400 may be configured to facilitate installation and power supply to the smoke detector 110 and the pressure control valve 112. For example, the housing 400 may include an area for housing the smoke detector 110, such as a conventional housing having slots or other exposure permitting the smoke detector 110 to sense the ambient atmosphere. The housing 400 may further include an area for the pressure control valve 112, which may be connected to the smoke detector 110 to receive signals from the smoke detector 110.

The housing 400 may further be configured to substantially accommodate a portion of the pressure tube 104 to facilitate control of the pressure in the pressure tube 104 by the pressure control valve 112. For example, the housing 400 may include one or more apertures through which the end of the pressure tube 104 may be connected to the pressure control valve 112. The housing 400 may comprise various materials including aluminum, aluminum alloy, cement, ceramic, copper, copper alloy, composites, iron, iron alloy, nickel, nickel alloy, organic materials, polymer, titanium, titanium alloy, and/or the like. The housing 400 may comprise various shapes, dimensions, and coatings according to various design considerations such as corrosion, cost, deformation, fracture, and/or the like. The housing 400 may be configured to include emissive properties with respect to ambient conditions and these properties may be achieved by including vents, holes, slats, permeable membranes, semi-permeable membranes, selectively permeable membranes, and/or the like within at least a portion of the housing 400. Further, the housing 400 may be disassembled into multiple sections 400A-C to facilitate installation and/or maintenance.

In addition, the housing 400 may be configured to provide power to the elements of the system, such as the smoke detector 110 and the pressure control valve 112. The power source may comprise any appropriate forms and source of power for the various elements. For example, the power source may include a main power source and a backup power source. In one embodiment, the main power source comprises a connection for receiving power from a conventional distribution outlet. The backup power source is configured to provide power in the event of a failure of the main power source, and may comprise any suitable source of power, such as one or more capacitors, batteries, uninterruptible power supplies, generators, solar cells, and/or the like. In the present embodiment, the backup power source includes two batteries 402, 404 disposed within the housing 400. The first battery 402 provides backup power to the smoke detector 110 and the second battery 404 provides backup power to the pressure control valve 112. In one embodiment, the pressure control valve 112 requires a higher power, more expensive, and/or less reliable battery than the smoke detector 110. Thus, the valve battery 404 may fail without disabling the backup power for the smoke detector 110 supplied by the fire detector battery 402.

Referring again to FIG. 1, the hazard control system 100 may be further configured to operate autonomously or in conjunction with external systems, for example a fire system control unit 109 for a building, vehicle, cargo holding area, or the like in which the hazard area 106 may be disposed within. For example, the hazard control system 100 and the hazard area 106 may both be disposed within a larger enclosed area 504 such as a warehouse, storage area, cargo holding area, wherein the fire system control unit 109 comprises at least part of a system designed to detect and/or suppress a fire condition within the enclosed area 504. The operation with the external systems may be configured in any suitable manner, for example to initiate an alarm, control the operation of the hazard control system 100, automatically notify emergency services, and/or the like.

Figure 5:
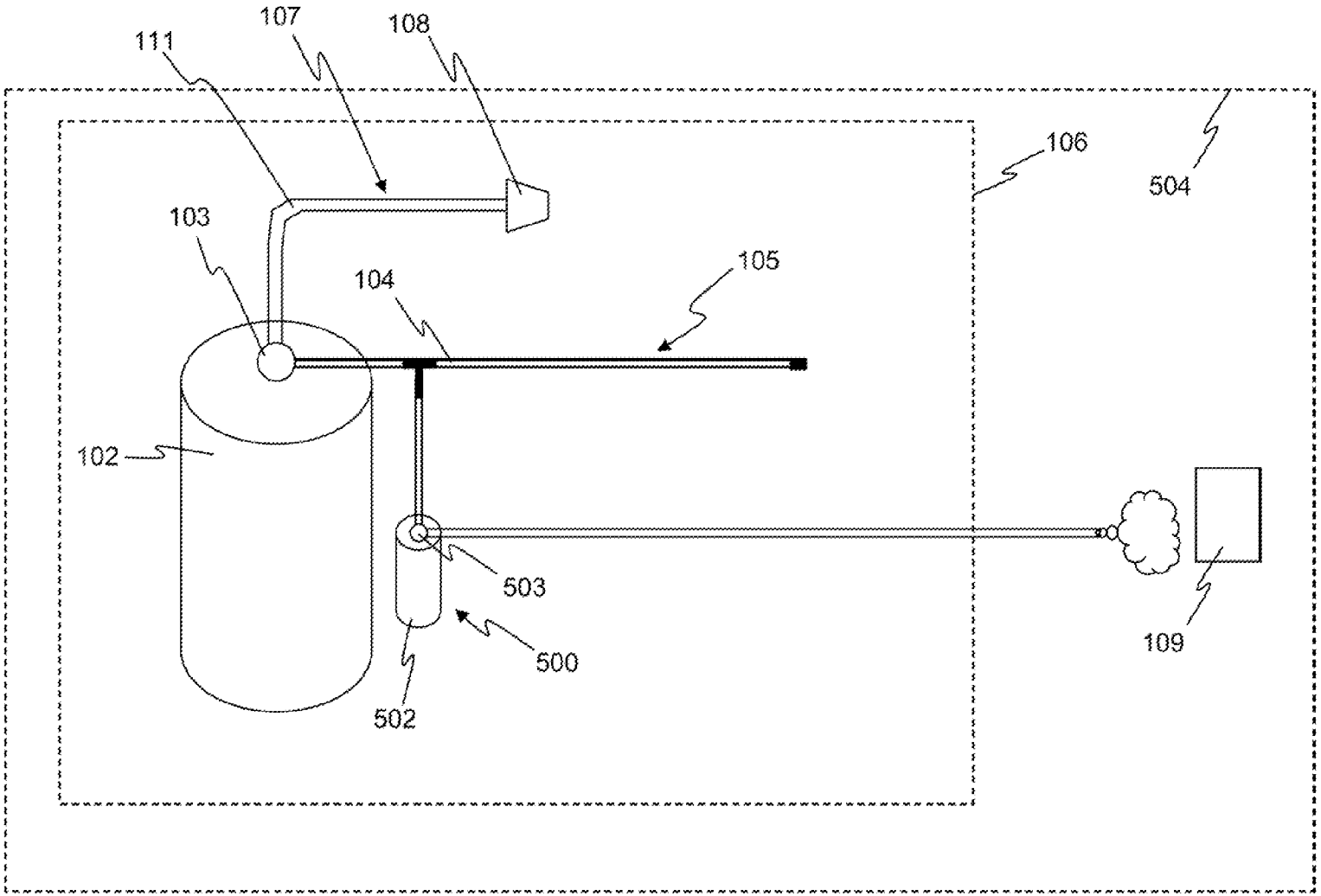
FIG. 5 representatively illustrates an embodiment of the hazard control system and a signaling system according to various aspects of the present invention.

Referring now to FIG. 5, the hazard control system 100 may further comprise a triggering system 500 configured to be responsive to the pneumatic signal generated by the pressure tube 104 following a loss of pressure. The triggering system 500 may be adapted in any suitable manner to activate, signal, notify, or otherwise communicate with the fire system control unit 109, such as remotely, electrically, and/or mechanically. The triggering system 500 may also be adapted to provide a signal suitable to the method of operation of the fire system control unit 109. For example, in one embodiment the triggering system 500 may comprise a trigger valve 503 coupled between a second pressure vessel 502 containing a signal material and the pressure tube 104. The trigger valve 503 may be configured to activate in response to a change in pressure on the pressure tube 104 side of the valve causing the signal material to be released. The fire system control unit 109 may sense the release of the signal material and respond accordingly, such as by activating an audible alarm, sending a signal to a monitored control panel, communicating with emergency services, or activating a secondary fire suppressant system.

The signal material may comprise any suitable substance, such as an inert gas, aerosol, colored particles, smoke, and/or a fire suppressant agent. For example, in one embodiment, the signal material may comprise compressed nitrogen contained within the pressure vessel 502 under a pre-determined pressure such that it forms a dissipating cloud upon release. In another embodiment, the signal material may comprise a powdered form of heavier than air particulate matter that forms a cloud upon release but subsequently falls out of suspension in the air.

In another embodiment, the triggering system 500 may comprise a communication interface connected to a remote control unit to signal the fire system control unit 109 in response to a detected fire condition. For example, the triggering system 500 may be suitably adapted to generate a radio frequency signal in response to the pneumatic signal to communicate to the fire system control unit 109 that a fire has been detected. The hazard control system 100 may also be configured to respond to signals from the fire system control unit 109, for example to provide status indicators for the hazard control system 100 and/or remotely activate the hazard control system 100.

The hazard control system 100 may further comprise additional elements for controlling and activating the hazard control system. For example, the hazard control system may include a manual system for manually activating the hazard control system. Referring again to FIG. 2, in one embodiment, the hazard control system 100 includes a manual valve 202 configured for manually activating the hazard control system 100. For example, the manual valve 202 may be coupled to the pressure tube 104 such that the manual valve 202 may release the internal pressure of the pressure tube 104. The manual valve 202 may be operated in any suitable manner, such as manual manipulation of the valve or in conjunction with an actuator, such as motor or the like.

The manual valve 202 may be located in any suitable location, such as substantially outside of the hazard area 106 or within the hazard area 106. The manual valve 202 may be coupled to the vessel 102, pressure tube 104, pressure control valve 112, and/or the like. For example, the manual valve 202 may be configured for operation with the vessel 102 such that actuation of the manual valve 202 directs extinguishant to the nozzle 108. The manual valve 202 may be configured for operation with the pressure tube 104 such that actuation of the manual valve 202 causes a change in pressure within the pressure tube 104 sufficient to direct extinguishant to the nozzle 108. The manual valve 202 may further be configured for operation with the pressure control valve 112 such that actuation of the manual valve 202 causes actuation of the pressure control valve 112, causing a change in pressure within the pressure tube 104 sufficient to direct extinguishant to the nozzle 108.

The hazard control system 100 may further comprise systems for providing additional responses in the event of a hazard being detected such that the hazard control system 100 may initiate further responses in addition to delivering the extinguishant in the event that a hazard is detected. The hazard control system 100 may be configured to prompt any appropriate response, such as alerting emergency personnel, sealing off an area from Unauthorized personnel, terminating or initiating ventilation of an area, deactivating hazardous machinery, and/or the like. For example, the hazard control system 100 may comprise a supplementary pressure switch 302. The supplementary pressure switch 302 may facilitate transmitting information relating to changes in pressure within the pressure tube 104 to external systems, such as by generating an electrical signal, mechanical signal, and/or other suitable signal in response to a pressure change within the coupled pressure tube 104.

In one embodiment, the supplementary pressure switch 302 may be coupled to machinery in the vicinity of the hazard area 106 to cut power or fuel supply to the machinery in the event that the supplementary pressure switch 302 produces a signal indicating a hazard condition as detected by the hazard control system 100.

In other embodiments, the hazard control system 100 may be configured with multiple vessels 102, pressure tubes 104, nozzles 108, pressure control valves 112, hazard detectors 110, manual valves 202, and/or supplementary pressure switches 302. For example, the hazard control system may be configured to include multiple vessels 102 coupled to a single nozzle 108 and hazard detector 110, such as if controlling the hazard area 106 includes drawing multiple types of extinguishant which cannot be stored together, or if the extinguishing anticipated hazards may require different extinguishants to be applied at different times. As another example, the hazard control system 100 may be configured to include more than one pressure tube 104 coupled to a single nozzle 108 and hazard detector 110, for example to provide multiple paths for delivering the extinguishant, or to draw different extinguishants in response to different fire conditions. Given the multiplicity of combinations of elements, these examples are illustrative rather than exhaustive.

Figure 4:
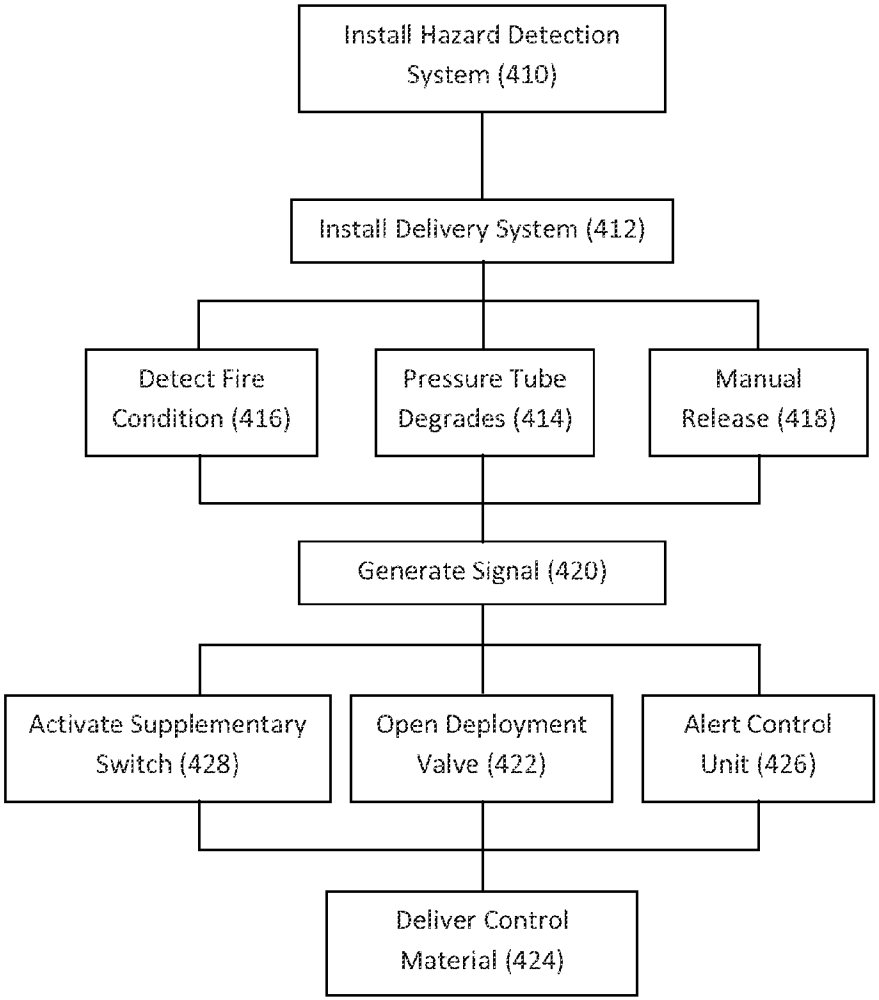
FIG. 4 is a flow diagram of a process for controlling a hazard.

Referring to FIG. 4, in operation, the hazard control system 100 is initially configured such that the hazard detection system 105 may sense relevant indicators of hazard conditions (410). For example, the pressure tube 104 may be exposed to the interior of a room or other enclosure so that in the event of a fire, the pressure tube 104 is exposed to heat from the fire. Likewise, relevant sensors, such as the smoke detector 110, may be positioned to sense relevant phenomena should a hazard occur. The delivery system 107 is also suitably configured to deliver a control material to areas where a hazard may occur (412), such as within the enclosure.

When a hazard occurs, the hazard detection system 105 may detect the hazard and activate the hazard control system 100. For example, the heat of a fire may degrade the pressure tube 104 (414), causing the interior pressure of the pressure tube 104 to be released, thus generating a pneumatic signal (420). In addition, a sensor, such as a smoke detector, may sense smoke or another relevant hazard indicator (416) and activate the hazard control system 100 to open the pressure control valve 112, likewise releasing the pressure in the pressure tube 104 and generating the pneumatic signal. Further, the signal may be generated by other systems, such as an external system or the manual valve 202 (418).

The signal is received by the deployment valve 103 and the trigger valve 503, which open (422) in response to the signal to deliver the control material and the signal material. The control material is dispensed through the delivery system into the hazard area 106 (424), thus tending to control the hazard. The signal material may transmitted to other systems, such as fire system control unit 109 (426) and/or the supplementary pressure switch 302 (428).

These and other embodiments for methods of controlling a hazard may incorporate concepts, embodiments, and configurations as described with respect to embodiments of apparatus for controlling a hazard as described above. The particular implementations shown and described are illustrative of the invention and its best mode and are not intended to otherwise limit the scope of the present invention in any way. Indeed, for the sake of brevity, conventional manufacturing, connection, preparation, and other functional aspects of the system may not be described in detail. Furthermore, the connecting lines shown in the various figures are intended to represent exemplary functional relationships and/or physical couplings between the various elements. Many alternative or additional functional relationships or physical connections may be present in a practical system.

The invention has been described with reference to specific exemplary embodiments. Various modifications and changes, however, may be made without departing from the scope of the present invention. The description and figures are to be regarded in an illustrative manner, rather than a restrictive one and all such modifications are intended to be included within the scope of the present invention. Accordingly, the scope of the invention should be determined by the generic embodiments described and their legal equivalents rather than by merely the specific examples described above. For example, the steps recited in any method or process embodiment may be executed in any order, unless otherwise expressly specified, and are not limited to the explicit order presented in the specific examples. Additionally, the components and/or elements recited in any apparatus embodiment may be assembled or otherwise operationally configured in a variety of permutations to produce substantially the same result as the present invention and are accordingly not limited to the specific configuration recited in the specific examples.

Benefits, other advantages and solutions to problems have been described above with regard to particular embodiments; however, any benefit, advantage, solution to problems or any element that may cause any particular benefit, advantage or solution to occur or to become more pronounced are not to be construed as critical, required or essential features or components.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The present invention has been described above with reference to a preferred embodiment. However, changes and modifications may be made to the preferred embodiment without departing from the scope of the present invention. These and other changes or modifications are intended to be included within the scope of the present invention, as expressed in the following claims.

The invention claimed is:

1. A fire protection and signaling system for a transportable unit having an enclosed area and a hazard area located within the enclosed area, comprising:

a pressure tube disposed within the hazard area of the transportable unit and adapted to have an internal pressure, wherein at least a portion of the pressure tube is configured to leak in response to exposure to heat and generate a pneumatic signal;

a pressure vessel disposed within the hazard area of the transportable unit and connected to the pressure tube, wherein the pressure vessel is configured to contain a fire suppressant;

a deployment valve coupled between the pressure tube and the pressure vessel, wherein the deployment valve is adapted to receive the pneumatic signal and release the fire suppressant upon receipt of the pneumatic signal:

a triggering system disposed within the hazard area of the transportable unit and connected to the pressure tube, wherein:

the triggering system is configured to generate a trigger signal in response to the pneumatic signal; and the trigger signal is transmitted to an area outside of the hazard area of the transportable unit.

2. A tire protection and signaling system according to claim 1, further comprising a delivery system connected to the deployment valve, wherein the delivery system is configured to deliver the fire suppressant to the hazard area.

3. A fire protection and signaling system according to claim 2, wherein the delivery system comprises:

a hose coupled to the deployment valve and configured to route the fire suppressant from the pressure vessel to a predetermined location within the hazard area; and a nozzle coupled to the hose and adapted to eject the fire suppressant from the hose into the hazard area.

4. A fire protection and signaling system according to claim 1, wherein the trigger signal comprises a signaling material ejected out from the hazard area.

5. A fire protection and signaling system according to claim 4, wherein the triggering system comprises:

a second pressure vessel disposed within the hazard area of the transportable unit and connected to the pressure tube, wherein the second pressure vessel is configured to contain the signaling material;

a trigger valve coupled between the pressure tube and the second pressure vessel, wherein the trigger valve is adapted to:

maintain the internal pressure inside the pressure tube until the pneumatic signal is received;

depressurize the second pressure vessel in response to the pneumatic signal; and allow the signaling material to escape from the second pressure vessel.

6. A fire protection and signaling system according to claim 1, further comprising:

a pressure control valve connected to the pressure tube, wherein the pressure control valve is configured to:

seal an end of the pressure tube opposite the deployment valve selectively unseal the end of the pressure tube in response to a detection signal and change the internal pressure of the pressure tube to generate the pneumatic signal; and a detector coupled to the pressure control valve and configured to generate the detection signal in response to a detection of a fire condition.

7. A fire protection and signaling system according to claim 6, further comprising a housing, wherein the housing contains at least a portion of the detector and the pressure control valve.

8. A fire protection and signaling system according to claim 7, wherein:

the housing has a hole defined therethrough; and the pressure tube is disposed through the hole to couple to the pressure control valve.

9. A fire protection system, comprising:

a suppressant system;

a detection system coupled to the suppressant system and adapted to generate a detection signal in response to a detection of a fire condition; and a signaling system coupled to the detection system and adapted to trigger a secondary fire sensing system by releasing material from the signaling system into an area proximate the secondary fire sensing system in response to the generated detection signal.

10. A fire protection system according to claim 9, wherein the suppressant system further comprises:

a pressure vessel configured to contain a suppressant material;

a deployment valve coupled to the pressure vessel and configured to:

seal the pressure vessel under a predetermined pressure;

release the suppressant material upon activation; and a delivery system coupled to the deployment valve and configured to deliver the suppressant material.

11. A fire protection system according to claim 10, wherein the delivery system comprises:

a hose coupled to the deployment valve and configured to route the suppressant material from the pressure vessel to a predetermined location; and a nozzle coupled to the hose and adapted to eject the suppressant material from the hose to a predetermined area.

12. A fire protection system according to claim 9, wherein the detection system comprises a sealed pressure tube adapted to have an internal pressure, wherein at least a portion of the pressure tube is configured to leak in response to exposure to heat and a decrease in the internal pressure generates the detection signal.

13. A fire protection system according to claim 12, wherein the signaling system comprises:

a second pressure vessel connected to the pressure tube and configured to contain the signaling material;

a trigger valve configured to couple between the pressure tube and the second pressure vessel, wherein the trigger valve is adapted to:

maintain the internal pressure inside the pressure tube until the detection signal is generated;

depressurize the second pressure vessel in response to the generated detection signal; and allow the signaling material to escape from the second pressure vessel.

14. A fire protection system according to claim 13, further comprising a second delivery system configured to deliver the signaling material to the secondary fire sensing system.

15. A fire protection system according to claim 13, wherein the signaling material comprises a compressed gas.

16. A method for protecting a hazard area against a fire condition and signaling a secondary fire control system, comprising:

coupling a pressure vessel configured to store a fire suppressant to a pressure tube configured to operate having an internal pressure, wherein at least a portion of the pressure tube is configured to leak in response to an exposure to the fire condition and change the internal pressure to generate a pneumatic signal;

coupling a deployment valve between the pressure vessel and the pressure tube to:

maintain the internal pressure inside the pressure tube until the pneumatic signal is received;

depressurize the pressure vessel in response to the pneumatic signal; and release the fire suppressant from the pressure vessel;

coupling a delivery system to the deployment valve, wherein the delivery system is configured to route the released fire suppressant to an area subject to the fire condition; and coupling a triggering system to the pressure tube, wherein:

the triggering system is configured to generate a trigger signal in response to the pneumatic signal; and the trigger signal is transmitted to the secondary fire control system.

17. A method according to claim 16, wherein the delivery system comprises:

a hose coupled to the deployment valve and configured to route the fire suppressant from the pressure vessel to a predetermined location within the hazard area; and a nozzle coupled to the hose and adapted to eject the fire suppressant from the hose into the hazard area.

18. A method according to claim 16, wherein the triggering system comprises:

a second pressure vessel connected to the pressure tube and configured to contain a signaling material;

a trigger valve configured to couple between the pressure tube and the second pressure vessel, wherein the trigger valve is adapted to:

maintain the internal pressure inside the pressure tube until the pneumatic signal is received;

depressurize the second pressure vessel in response to the pneumatic signal; and release the signaling material from the second pressure vessel.

19. A method according to claim 18, wherein transmitting the trigger signal comprises directing the released signaling material towards the secondary fire control system.

* * * * *

UNITED STATES PATENT AND TRADEMARK OFFICE

CERTIFICATE OF CORRECTION

PATENT NO. : 8,459,369 B2
APPLICATION NO. : 12/907872
DATED : June 11, 2013
INVENTOR(S) : Eckholm et al.

It is certified that error appears in the above-identified patent and that said Letters Patent is hereby corrected as shown below:

In the claims

In column 10, claim 2, line 33, please delete “tire” and insert --fire--.

Signed and Sealed this
Fifteenth Day of December, 2015

Michelle K. Lee

Michelle K. Lee
*Director of the United States Patent and Trademark Office*